US006955583B2

(12) United States Patent
Dall'Aglio

(10) Patent No.: US 6,955,583 B2
(45) Date of Patent: Oct. 18, 2005

(54) APPARATUS FOR THE DIAMETER CHECKING OF ECCENTRIC PORTIONS OF A MECHANICAL PIECE IN THE COURSE OF THE MACHINING IN A GRINDING MACHINE

(75) Inventor: Carlo Dall'Aglio, Castello d'Argile (IT)

(73) Assignee: Marposs Societa' per Azioni, Bentivoglio (IT)

( * ) Notice: Subject to any disclaimer, the term of this patent is extended or adjusted under 35 U.S.C. 154(b) by 0 days.

(21) Appl. No.: 10/476,582

(22) PCT Filed: Apr. 22, 2002

(86) PCT No.: PCT/EP02/04394

§ 371 (c)(1),
(2), (4) Date: Oct. 31, 2003

(87) PCT Pub. No.: WO02/090047

PCT Pub. Date: Nov. 14, 2002

(65) Prior Publication Data

US 2004/0137824 A1 Jul. 15, 2004

(30) Foreign Application Priority Data

May 7, 2001 (IT) ..... BO2001A0268

(51) Int. Cl.[7] ..... B24B 49/00
(52) U.S. Cl. ..... 451/5; 451/8; 33/555.3
(58) Field of Search ..... 451/5, 8, 9, 62, 451/49, 407, 408, 242, 244; 33/555.1, 555.3; 82/157, 164, 162

(56) References Cited

U.S. PATENT DOCUMENTS

| | | | | |
|---|---|---|---|---|
| 1,941,456 A | | 1/1934 | Arnold | |
| 3,603,044 A | * | 9/1971 | Price | 451/4 |
| 4,637,144 A | | 1/1987 | Schemel | |
| 5,150,545 A | * | 9/1992 | Esteve | 451/8 |
| 6,067,721 A | | 5/2000 | Dall'Aglio et al. | |

FOREIGN PATENT DOCUMENTS

| | | |
|---|---|---|
| GB | 405817 | 2/1934 |

* cited by examiner

*Primary Examiner*—Robert A. Rose
(74) *Attorney, Agent, or Firm*—Dickstein Shapiro Morin & Oshinsky LLP

(57) ABSTRACT

An apparatus (10) for checking the diameter of an eccentric pin (8') of a small-size shaft (8), for example a shaft for compressors, includes a support (16), a first arm (19) rotating with respect to the support (16), a second arm (22) rotating with respect to the first, a Vee-shaped reference device (28) carried by the second arm, a measuring device (25,26,24,37,38) associated with the reference device, limiting devices (29,29',30,30') for limiting the rotations of the arms and thrust means (33) for keeping the reference device in contact with the pin in the course of the checking. A hydraulic actuator (13) displaces the apparatus (10) from a rest condition to a checking condition, in which the reference device (28) is in contact with the pin (8') to be checked, and vice versa.

15 Claims, 5 Drawing Sheets

APPARATUS FOR THE DIAMETER CHECKING OF ECCENTRIC PORTIONS OF A MECHANICAL PIECE IN THE COURSE OF THE MACHINING IN A GRINDING MACHINE

TECHNICAL FIELD

The present invention relates to an apparatus for the diameter checking of a substantially cylindrical eccentric portion of a mechanical piece that defines a geometrical axis, during eccentric rotations of said portion about the geometrical axis, including a substantially Vee-shaped reference device, adapted for cooperating with the eccentric portion to be checked, a measuring device, movable with the reference device, and a support device for supporting the reference device and the measuring device, the support device including a support element, a first rotating, coupling element coupled to the support element so as to rotate about an axis of rotation parallel to the geometrical axis, a second rotating, coupling element that carries the reference device and the measuring device and is coupled to the first coupling element so as to rotate relative to it about an additional axis of rotation parallel to the geometrical axis and to the axis of rotation, and limiting and reference devices, for limiting the rotations of the first rotating, coupling element and the second rotating, coupling element and for defining a rest condition of the apparatus without interfering with displacements of the reference device following the substantially cylindrical portion during said eccentric rotations.

BACKGROUND ART

There are known apparatuses with these characteristics for the checking of pins rotating with orbital motion in the course of the machining in a grinding machine. For example, international patent application published with No. WO-A-9712724, filed by the same applicant of the present patent application, discloses an apparatus for the checking of the diameter of crankpins in orbital motion in the course of the machining of crankshafts in a grinding machine including a bed, a worktable, a grinding-wheel slide and a grinding wheel coupled to the grinding-wheel slide. The apparatus is coupled to the grinding-wheel slide, contacts the piece and follows it in the course of its orbital motion substantially by virtue of the force of gravity applied to the considerable mass of the apparatus. The apparatus is particularly suitable for checking crankshafts for automobile engines and has appropriate mass and layout dimensions.

Owing to the considerable layout dimensions, apparatuses of this type cannot be coupled to the grinding-wheel slide of small-size grinding machines, as those utilized for the machining of shafts for compressors, like the one (8) shown in FIG. 1, more particularly its associated eccentric pin 8'. The dimensions of these shafts are by far smaller than those of the crankshafts: a shaft for compressors is typically 150–200 mm long and the eccentric pin is approximately 12–40 mm in diameter, while a crankshaft measures at least 50–100 cm in length and the diameter of a crankpin may range, for example, within 40 to 90 mm. In order to carry out the diameter checking, during the machining of these eccentric pins, the presently utilized applications are substantially similar to the one illustrated and described in italian patent No. 1258154. These applications (an example is shown in simplified form in FIG. 2) include two stationary gauging or measuring heads H1 and H2, coupled to the machine bed B or to the worktable, with feelers for contacting the pin, in the course of its eccentric rotation, just at two diametrally opposite points, P1 and P2, of its trajectory T. The diameter of the pin is calculated by evaluating information relating to the position of said two points of the trajectory and carrying out appropriate processings that keep into account the geometry of the checked piece.

Even though the utilization of a checking application of this type is simple, it cannot guarantee satisfactory metrological performances because, among other things, the diameter of the pin is "deduced" on the basis of checkings carried out by touching the same point of the surface in two opposite arrangements of the piece.

It is not possible to determine whether any possible variations detected by either of the two heads is due to diameter variations, to shape and/or eccentricity errors or to a combination of such factors. Furthermore, the measurement combining the detections of the two heads is also affected by the mutual arrangement existing between the heads, and by possible modifications of said arrangement. Furthermore, the detecting and processing operation is slow and, whenever the nominal diameter dimensions of the piece to be checked vary, it is necessary to manually reset the application and consequently this implies machine downtime and considerable loss of time.

DISCLOSURE OF INVENTION

An object of the present invention is to provide an apparatus for checking eccentric pins of small-size shafts, while the pins eccentrically rotate in the course of the machining in a grinding machine, that overcomes the drawbacks of the known apparatuses and provides good metrological performance and high standards of reliability and flexibility.

This and other objects are attained by an apparatus according to claim 1.

An apparatus according to the invention provides the advantage of being able to follow the piece, eccentrically rotating at high speeds (in the order of some hundreds of revolutions per minute), thanks to its limited mass and to the traction force of the spring, as hereinafter disclosed.

BRIEF DESCRIPTION OF THE DRAWINGS

The invention is now described in more detail with reference to the enclosed sheets of drawings, given by way of non-limiting example, wherein.

BEST MODE FOR CARRYING OUT THE INVENTION

Figure 3:
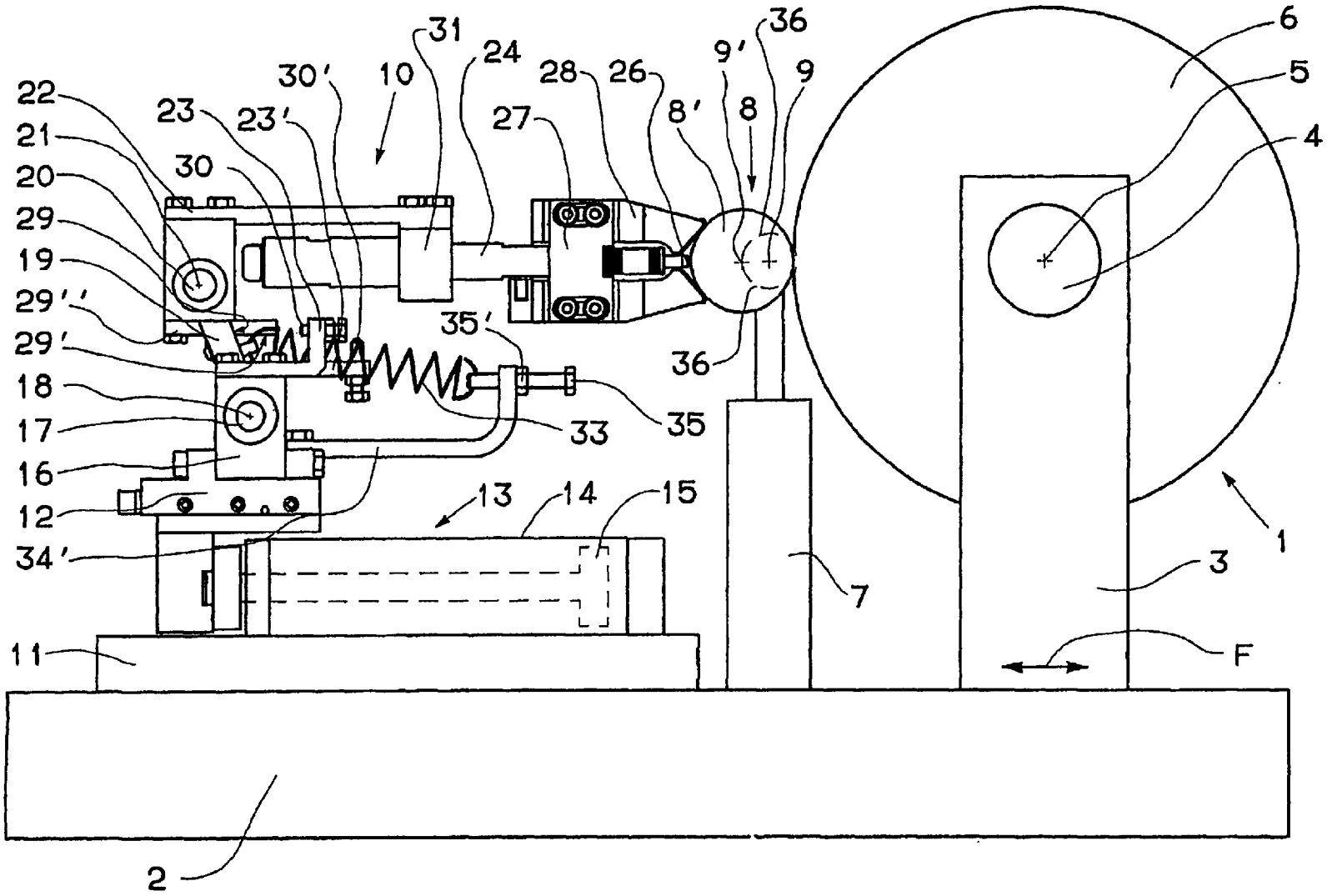
FIG. 3 is a side view of a measuring apparatus according to the invention, mounted on the bed of a grinding machine for grinding eccentric pins of shafts for compressors.

With reference to FIG. 3, a computer numerical control ("CNC") grinding machine 1 includes a bed 2, to which there is coupled a grinding-wheel slide 3, for supporting a spindle 4, that defines the axis of rotation 5 of the grinding wheel 6. The grinding-wheel slide 3 can displace relative to bed 2 in a known way as indicated in FIG. 3 by arrow F.

A worktable 7, carrying the piece to be checked—for example a shaft 8 for compressors with at least a cylindrical eccentric portion, or pin, 8'—is coupled to bed 2 between a spindle and a tailstock, not shown, that define the axis of rotation 9, coincident with the main geometrical axis of piece 8. Consequently, in the course of the rotation of piece 8, crankpin 8' performs an eccentric motion about axis 9.

Figure 4:
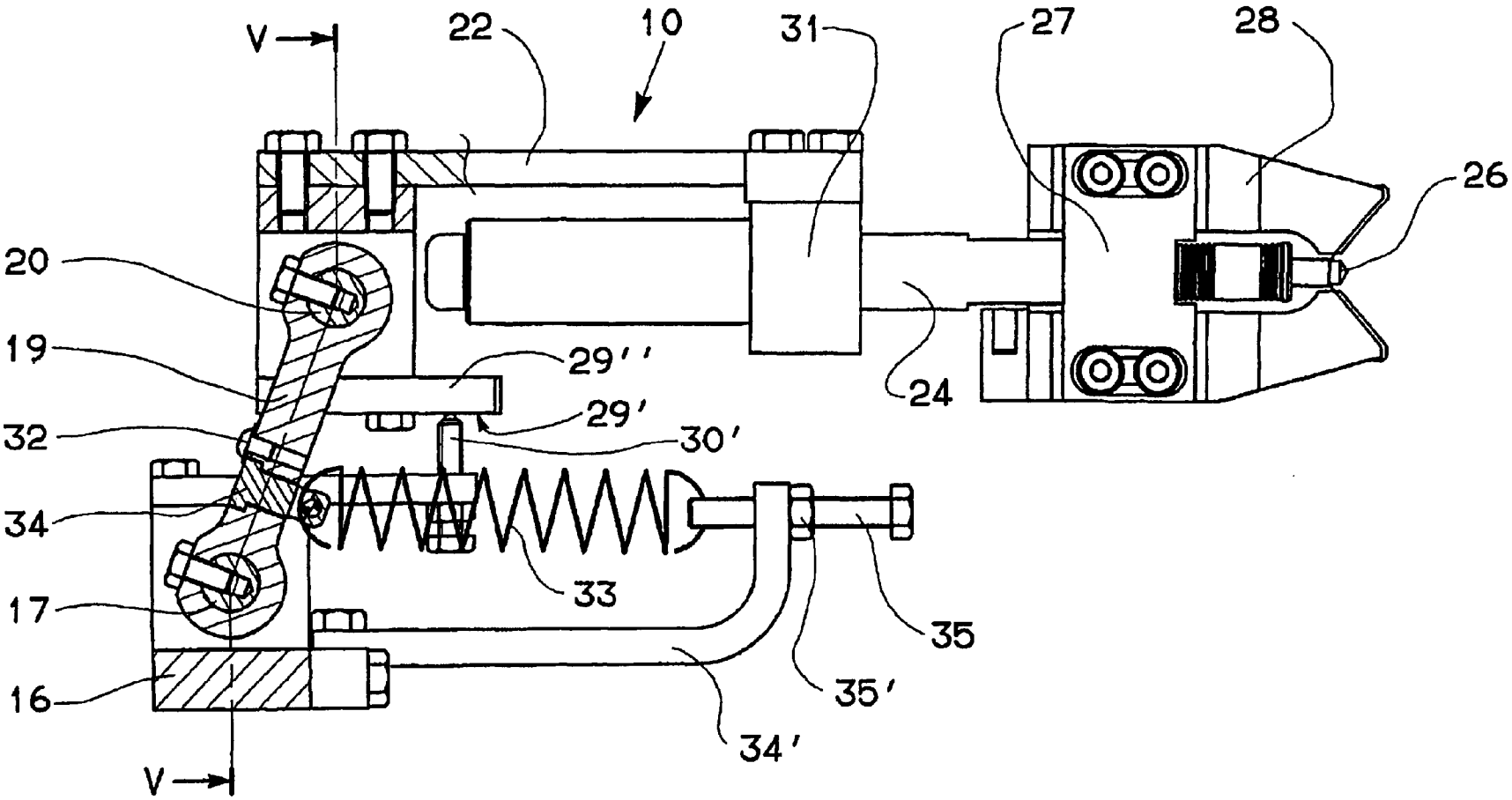
FIG. 4 is an enlarged and partly cross-sectional view of the apparatus shown in FIG. 3, according to a different operating position.
Figure 5:
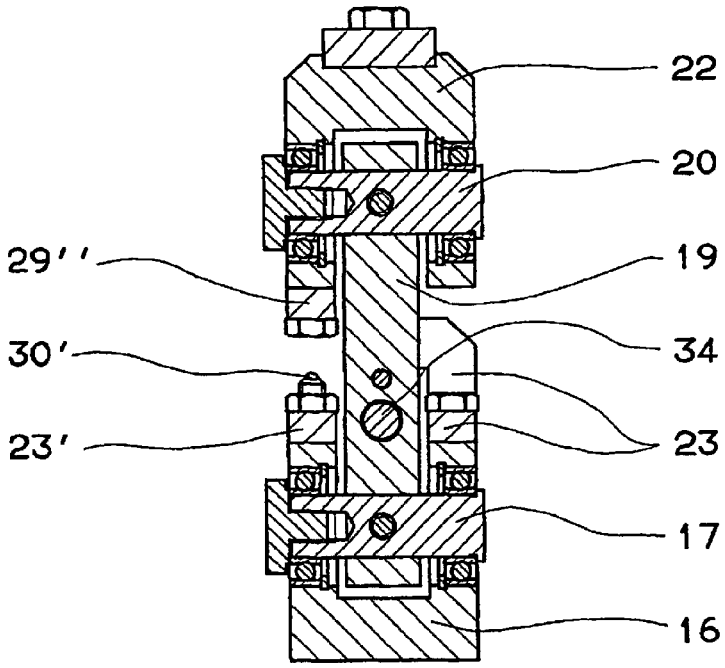
FIG. 5 is a cross-sectional view of the measuring apparatus shown in FIG. 4, in a different scale and according to different planes, identified by line V—V in FIG. 4.

Moreover, there is coupled to bed 2 an apparatus 10—also shown in FIGS. 4 and 5—for checking, during the machining, the diametral dimensions and/or possible shape errors of pin 8' of piece 8. The apparatus 10 is coupled to a slide 12, that can displace in a transversal direction and is activated by a hydraulic actuator 13 including a cylinder 14 and a piston 15. Cylinder 14 of the hydraulic actuator 13 is coupled to bed 2 by means of a support 11, while piston 15 carries slide 12. The apparatus 10 includes a support element 16 coupled to slide 12 and, by means of a rotation pin 17—that defines a first axis of rotation 18, parallel to the axis of rotation 5 of grinding wheel 6 and to the axis of rotation 9 of piece 8—it supports a first rotating, coupling element 19. In turn, coupling element 19, by means of a rotation pin 20—that defines a second axis of rotation 21 parallel to the axis of rotation 5 of grinding wheel 6 and to the axis of rotation 9 of piece 8—supports a second rotating, coupling element 22.

A measuring device includes a tubular guide casing 24 coupled by means of screws, at an enlarged portion 31, to coupling element 22. Within tubular guide casing 24 there is a transmission rod 25, shown in FIG. 6, that can axially translate and carries a feeler 26, for contacting the surface of pin 8' of piece 8 to be checked.

The free end of the tubular guide casing 24 is coupled to a support block 27 for supporting a reference device 28, in the shape of a Vee, for engaging with the surface of pin 8' of piece 8 to be checked, by virtue of the rotations enabled by pins 17 and 20. The transmission rod 25 is movable along the bisecting line of the Vee-shaped reference device 28.

Limiting and reference devices, shown in FIG. 3 and partially in FIG. 4, include a first and a second pair of abutment surfaces. The first pair comprises a surface 29 of the rotating, coupling element 19 and a surface of a corresponding abutment element, more specifically a dowel 30 coupled in an adjustable way to a stanchion 23 integral with the support element 16. The second pair of abutment surfaces includes a surface 29' of a block 29" coupled to the second rotating, coupling element 22 and a surface of a corresponding abutment element, more specifically a dowel 30' coupled in an adjustable way to a plate 23' integral with the support element 16. The rotations of the coupling element 19 about the axis of rotation 18 are limited, in a clockwise direction (with reference to FIGS. 3 and 4), by contact occurring between the abutment surface 29 and the dowel 30, whereas rotations of the coupling element 22 are limited, in a clockwise direction (FIGS. 3 and 4), by contact occurring between the abutment surface 29' and dowel 30'. The position of dowels 30 and 30' can be adjusted, as previously mentioned, for the purpose of modifying the amount of the rotations of the first coupling element 19 and the second coupling element 22.

A thrust device includes a return spring 33, with its ends coupled to a first support element 34, clamped to the first coupling element 19 by means of the head 32 of a screw, and integrally rotating together with it about axis 18, and to the end of a screw 35, screwed to a second support element 34' fixed to the support element 16.

The previously mentioned return spring 33 keeps in rest conditions, the abutment surface 29 of the coupling element 19 in abutment with dowel 30, and, in the course of the checking, urges the reference device 28 against the surface of pin 8' of the piece 8 keeping feeler 26 in contact with such surface of the pin 8'. It is possible to decrease or increase the traction force of spring 33 by screwing or unscrewing, respectively, screw 35 and then operating a nut 35' for locking said screw 35 in the required position.

In rest conditions, in other words when there is no piece 8 to be checked on worktable 7, the position of the coupling elements 19 and 22 is defined by the abutment between surface 29 and dowel 30—urged against each other by the thrust of spring 33—and, respectively, by contact between surface 29' and dowel 30'; this contact is determined by the force of gravity that acts on element 22 and the measuring device coupled to it. In said rest condition, hydraulic actuator 13 maintains slide 12 in a retracted position according to which the Vee-shaped reference device 28 is far from worktable 7.

Then piece 8 is positioned on worktable 7, between the spindle and the tailstock. Consequently, pin 8' undergoes an eccentric rotation about axis 9. In FIG. 3 a dashed line indicates the trajectory 36 of axis 9' of pin 8', also shown in FIG. 1, in the course of its eccentric rotation. Before piece 8 starts to rotate, the hydraulic actuator 13 displaces slide 12 to a checking position according to which surfaces of the reference device 28 contact the surface of pin 8'.

It should be realized that reference device 28 can be displaced towards piece 8 while the latter is in rotation. Regardless of whether the piece is stationary or moving, it is in any case possible to rapidly achieve correct cooperation between pin 8' and reference device 28.

Thanks to spring 33, reference device 28 maintains contact with pin 8' during the motion of piece 8, thus following it in its eccentric rotation.

Subsequently to the arrangement of the Vee 28 on the pin 8', the surfaces 29 and 29' get detached from their associated dowels 30, 30' and, by virtue of the appropriate position undertaken by dowels 30, 30' and by slide 12, the limiting and reference means do not interfere with the displacements of the reference device 28 following the pin 8'.

The return of the checking apparatus 10 to the rest condition, effected by the hydraulic actuator, is normally controlled by the grinding machine numerical control when, on the basis of the measurement signal detected and transmitted by the checking apparatus, it is detected that pin 8' has reached the required (diameter) dimension. This return is effected by means of an extension of piston 15 of hydraulic actuator 13, causing the reference device 28 to move away from the surface of pin 8' and the surfaces 29 and 29' to contact their associated dowels 30 and 30' again. Then the machining of another pin 8' takes place, or—if the machining of piece 8 has ended—piece 8 is unloaded, manually or automatically, and another piece 8 is loaded on worktable 7.

Figure 1:
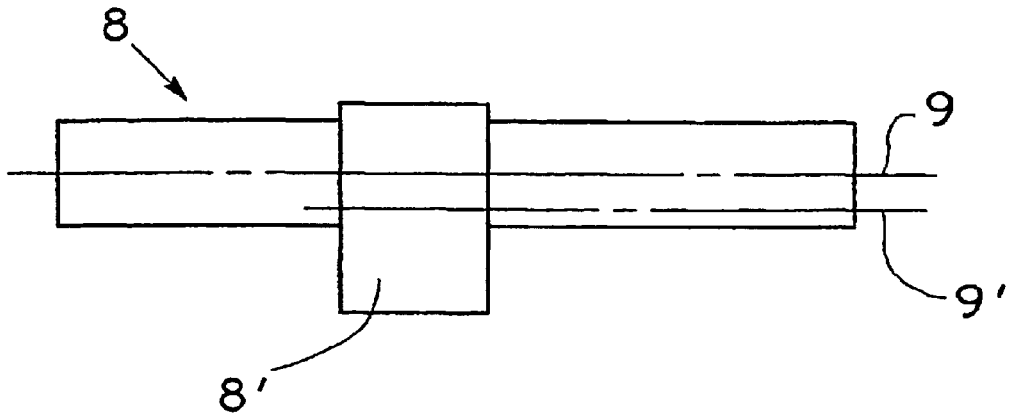
FIG. 1 shows a shaft for compressors.

In the event the piece, unlike the one shown in FIG. 1, has a plurality of eccentric pins and there be the need to machine a fresh pin 8', the latter is carried in front of grinding wheel 6, typically by displacing worktable 7 (in the case of a grinding machine with a single grinding wheel), and the checking apparatus 10 is moved to the operating position.

Figure 6:
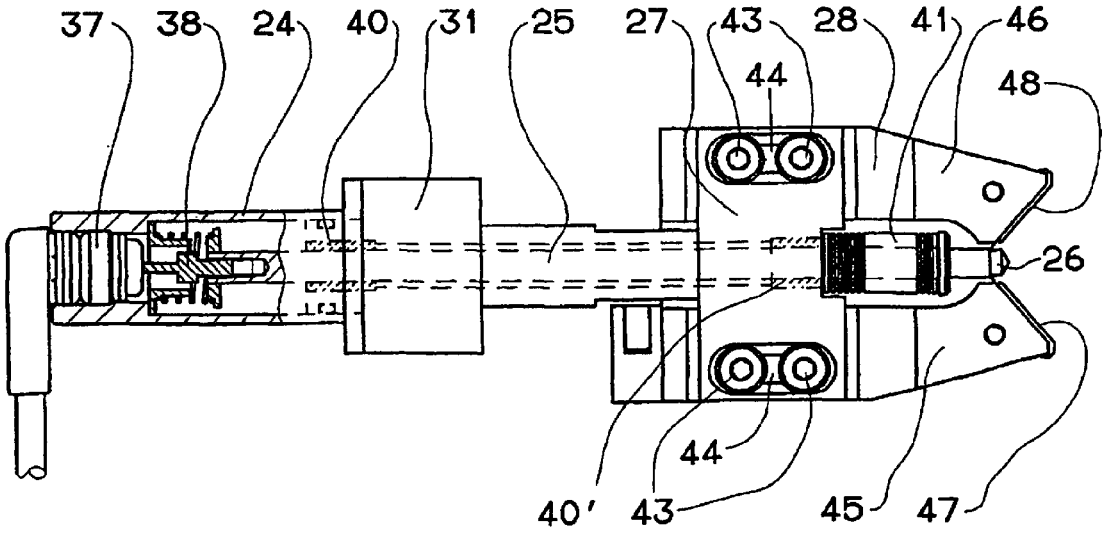
FIG. 6 shows a component part, in a different scale, of the measuring device of the apparatus shown in FIG. 4.

FIG. 6 shows in more detail some elements of the measuring device of apparatus 10.

The axial displacements of the transmission rod 25 relative to a reference position are detected by a measurement transducer 37, of the known type, coupled to the tubular casing 24 and with a magnetic core coupled to a stem 38 screwed to the transmission rod 25.

The axial displacement of the transmission rod 25 is guided by two bushings 40, 40' arranged between casing 24 and rod 25. A metal bellows 41, that is stiff with respect to torsional forces and has its ends fixed to rod 25 and casing 24, respectively, accomplishes the dual function of preventing rod 25 from rotating with respect to casing 24 (thus preventing feeler 26 from taking improper positions) and sealing the lower end of casing 24.

The reference device 28 consists of two elements 45 and 46 with slanting side surfaces, whereto there are secured two bars 47 and 48.

The coupling between support block 27 and reference device 28 is provided by screws 43 traversing slots 44 and enables axial mutual adjustments, substantially along the direction of the bisecting line of the Vee defined by bars 47 and 48, for ensuring contact of the two bars 47 and 48 and that of feeler 26 with pin 8' of piece 8.

Each reference device 28 features particular dimensions and geometry (e.g. the Vee angle) allowing to cover a specific measuring range. When the latter varies, it is possible to replace the reference device with another one featuring a different layout by carrying out simple and rapid operations.

Even feeler 26 can be replaced in an equally rapid and simple way whenever it is required to do so by the specific application.

Figure 7:
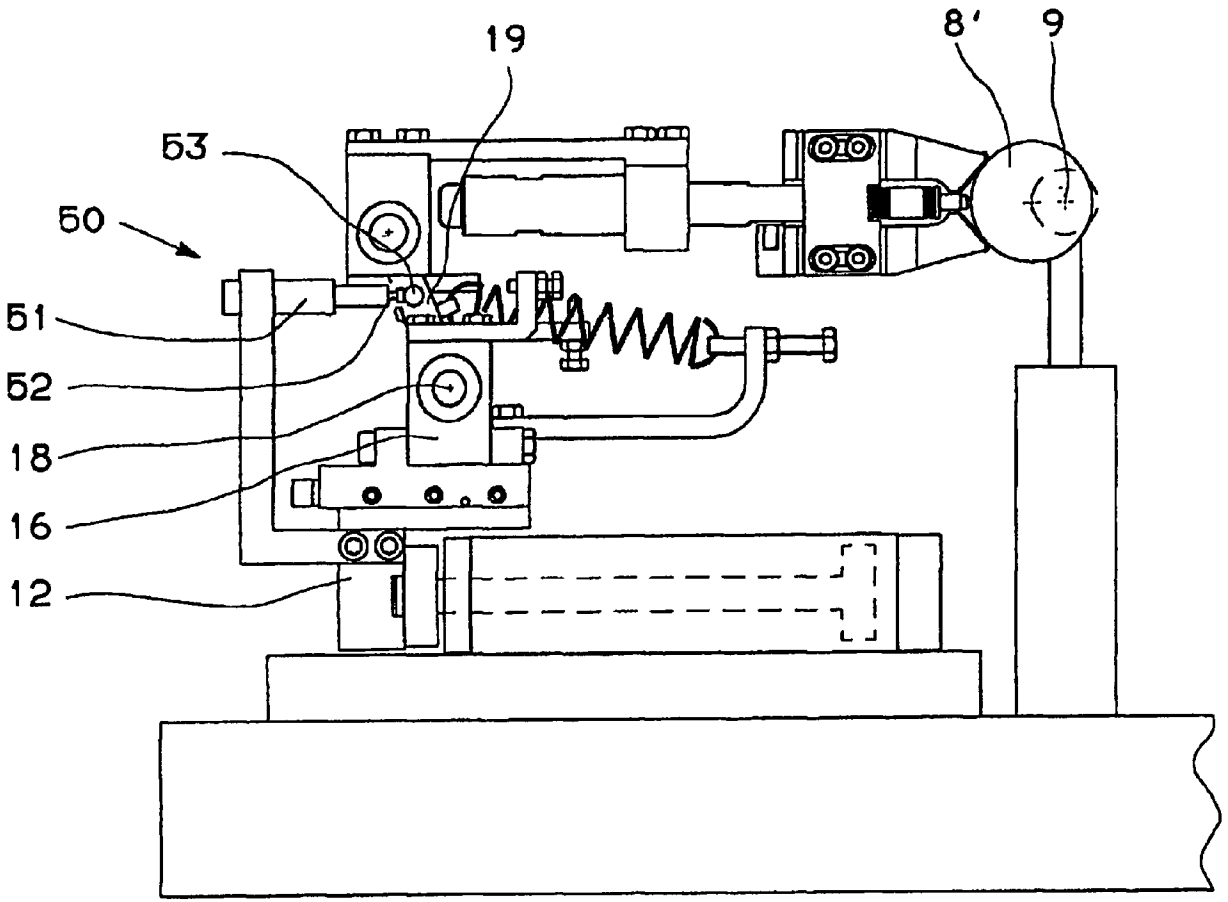
FIG. 7 is a side view of a measuring apparatus according to a different embodiment of the invention.

The apparatus shown in FIG. 7 is substantially similar to the one of FIGS. 3 to 6, and features a detecting device 50, for detecting the angular position of pin 8' about axis 9. The detecting device 50 comprises a linear gauge, e.g. a so-called "cartridge head" 51, including an axially movable feeler 52 and a transducer—well-known and not shown in the figure—that provides signals indicative of the displacements of feeler 52. A protruding element or stud 53 is integrally coupled to the first coupling element 19, and moves with it, substantially tracing an arc about axis 18. The head 51 is connected to the slide 12—and consequently to the support element 16—in a proper position (e.g. by means of a bracket, as shown in FIG. 7) allowing the feeler 52 and the stud 53 to intermittently come in touch with each other in the course of the checking of eccentrically rotating pin 8'. In particular, the contact between feeler 52 and stud 53 takes place at angular positions of pin 8' about the position shown in FIG. 7. The signal provided by head 51, gives indications about arrangements of the first coupling element 19 with respect to the support element 16, and allows to detect when pin 8' assumes the position of FIG. 7, (e.g. it happens when the signal of head 51 reaches a maximum or minimum value). In such a way, the angular position of pin 81 during its eccentric rotation about axis 9 can be detected.

According to alternative embodiments not shown in the drawings, the detecting device 50 can include linear gauges 51 differently arranged with respect to what is shown in FIG. 7. For instance, the linear gauge 51 can be vertically arranged, and include a bar shaped feeler holding continuous contact with stud 53 during the checking cycle of pin 8' and moving along a transversal direction with respect to the arc traced by stud 53. In this case too, by monitoring the signal provided by gauge 51, it is possible to detect the angular arrangement of pin 8' about the axis of rotation 9.

The apparatus is particularly suitable for the checking of the diameter of eccentrically rotating cylindrical portions of mechanical pieces, but it can be generally utilized for the checking of diameters of pieces with rotational symmetry while rotating eccentrically or about their geometrical axes. Even rotating parts having grooved surfaces can be checked, by choosing a proper reference device 28 and a feeler 26 having a suitable contact surface (e.g. planar), different with respect to the one that is shown in the drawings.

Figure 2:
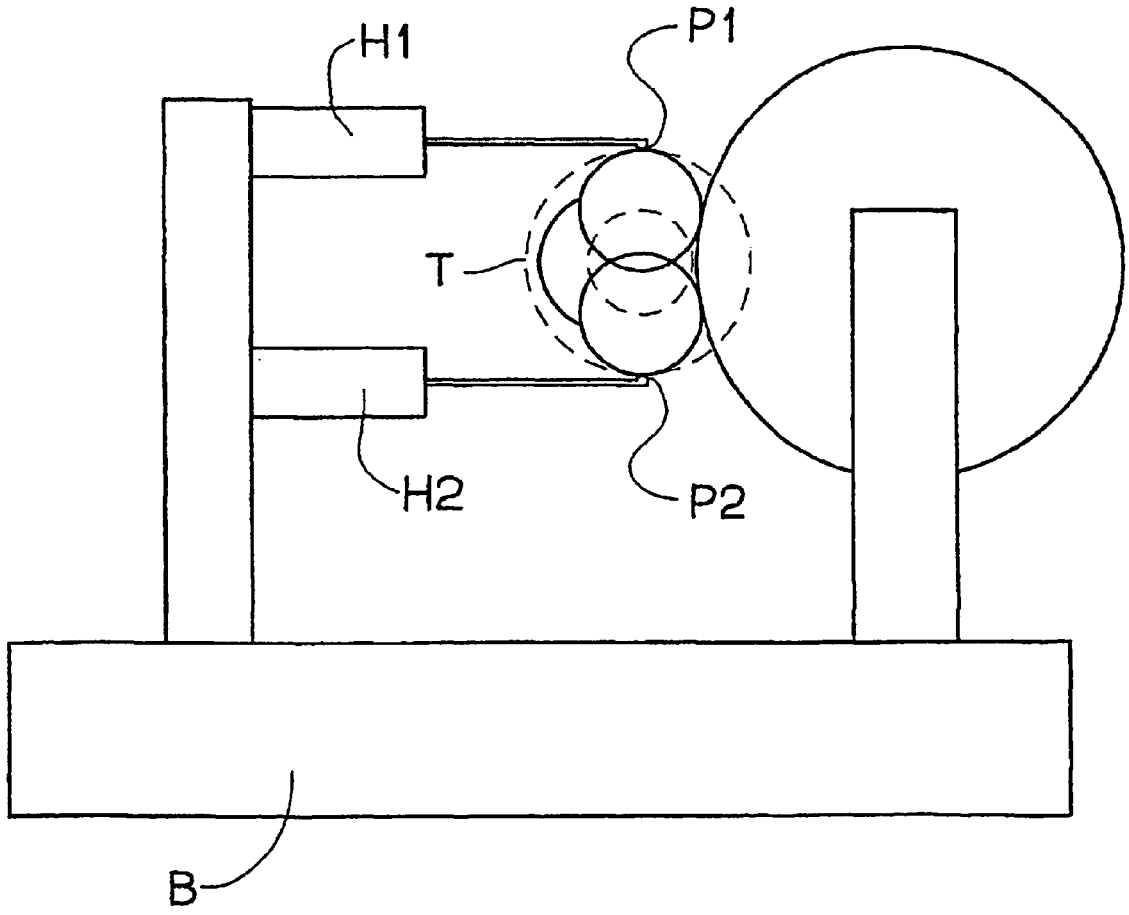
FIG. 2 is a lateral view, shown in simplified form, of a known measuring apparatus for the checking of the diameter of eccentric pins of a shaft for compressors, in the course of the machining in a grinding machine.

An apparatus according to the invention enables to obtain remarkable metrological performance as, unlike what occurs in the known applications for eccentrically rotating parts (FIG. 2), the checking of the piece takes place during all the phases of the machining. Furthermore, this enables to detect, instant by instant and without delay, the dimensions of pins 8', thus allowing to retrofit the machine cycle by adjusting some machining parameters.

Lastly, the apparatus according to the invention enables to check the diameter of pieces with nominal dimensions that differ within a specific range (typically 25 mm), without there being the need to substitute or displace any component parts. In this way it is possible to machine and check, without stopping the machine, pieces that, although belonging to the same family, have different nominal dimensions among each other.

Variants with respect to what has been herein described are feasible and more specifically the checking apparatus can be equipped with additional feelers, associated transmission rods and measurement transducers for detecting additional diameters and other dimensions and/or geometrical or shape features of the pin 8' being machined. It is obvious that in a multi-wheel grinding machine for simultaneously machining a plurality of pins 8' there can be foreseen as many checking apparatuses 10.

An apparatus according to the present invention can be utilized, apart from carrying out checkings in the course of the machining as herein described, also for carrying out checkings of the pieces before or after the machining.

In an apparatus according to the present invention, feeler 26 can also translate along a direction slightly sloping with respect to the bisecting line of the Vee of the reference device 28, in order to increase the apparatus sensitivity when performing certain types of checkings (e.g. roundness checkings). In the event the machine layout dimensions do not enable the coupling of the apparatus in a way whereby the measuring device displaces horizontally, according to the preferred configuration shown in the figures, it is possible to couple the apparatus to the machine so that the measuring device arranges itself along directions differing from the horizontal one, according to other configurations which guarantee the resting, in rest conditions, of the surface 29' on dowel 30' owing to the force of gravity, or thanks to the action of an additional spring.

What is claimed is:

1. An apparatus for the diameter checking of a substantially cylindrical eccentric portion of a mechanical piece that defines a geometrical axis, during eccentric rotations of said portion about said geometrical axis, including a substantially Vee-shaped reference device adapted for cooperating with said eccentric portion to be checked, a measuring device, movable with the substantially Vee-shaped reference device, and a support device for supporting the substantially Vee-shaped reference device and the measuring device, the support device including a support element, a first rotating, coupling element coupled to the support element so as to rotate about an axis of rotation parallel to said geometrical axis, a second rotating, coupling element that carries the substantially Vee-shaped reference device and the measuring device and is coupled to the first coupling element so as to rotate relative to it about an additional axis of rotation parallel to said geometrical axis and to said axis of rotation, limiting and reference devices with a first pair and a second pair of abutment surfaces urged to cooperate with each other for limiting the rotations of said first rotating, coupling element and said second rotating, coupling element and for defining a rest condition of the apparatus without interfering with displacements of the substantially Vee-shaped reference device following the substantially cylindrical portion during said eccentric rotations, and a thrust device for urging said substantially Vee-shaped reference device in abutment with the cylindrical eccentric portion to be checked and keeping the substantially Vee-shaped reference device engaged with the cylindrical eccentric portion during said eccentric rotations, the thrust device being arranged between the support element and one of said first and second coupling elements, the abutment surfaces of said first pair and second pair being arranged so that they get detached from each other when the substantially Vee-shaped reference device cooperates with the eccentric portion to be checked.

2. The apparatus according to claim 1, wherein the abutment surfaces of said first pair are urged to cooperate with each other by the thrust of the thrust device, and the abutment surfaces of said second pair are urged to cooperate with each other by the force of gravity.

3. An apparatus for the diameter checking of a substantially cylindrical eccentric portion of a mechanical piece that defines a geometrical axis, during eccentric rotations of said portion about said geometrical axis, including a substantially Vee-shaped reference device adapted for cooperating with said eccentric portion to be checked, a measuring device, movable with the substantially Vee-shaped reference device, and a support device for supporting the substantially Vee-shaped reference device and the measuring device, the support device including a support element, a first rotating, coupling element coupled to the support element so as to rotate about an axis of rotation parallel to said geometrical axis, a second rotating, coupling element that carries the substantially Vee-shaped reference device and the measuring device and is coupled to the first coupling element so as to rotate relative to it about an additional axis of rotation parallel to said geometrical axis and to said axis of rotation, limiting and reference device with a first pair and a second pair of abutment surfaces urged to cooperate with each other for limiting the rotations of said first rotating, coupling element and said second rotating, coupling element and for defining a rest condition of the apparatus without interfering with displacements of the substantially Vee-shaped reference device following the substantially cylindrical portion during said eccentric rotations, and a thrust device for urging said substantially Vee-shaped reference device in abutment with the cylindrical eccentric portion to be checked and keeping the substantially Vee-shaped reference device engaged with the cylindrical eccentric portion during said eccentric rotations, the thrust device being arranged between the support element and one of said first and second coupling elements, the abutment surfaces of said first pair and second pair are detached from each other during the checking of the eccentric portion, wherein said first pair of abutment surfaces includes surfaces integral with the support element and with the first coupling element that are urged to cooperate with each other by the thrust of the thrust device, and said second pair of abutment surfaces includes surfaces integral with the support element and the second coupling element, the abutment surfaces of the second pair being urged to cooperate with each other by the force of gravity applied to the second coupling element, the substantially Vee-shaped reference device and the measuring device.

4. The apparatus according to claim 3, wherein said limiting and reference devices include dowels that define surfaces of said first and second pair of abutment surfaces, the dowels being coupled, in an adjustable way, to a stanchion and to a plate, respectively, the stanchion and the plate being coupled to the support element.

5. The apparatus according to claim 1, wherein said thrust device includes a return spring coupled to said first coupling element and said support element.

6. The apparatus according to claim 1, for checking the diameter of said substantially cylindrical portion eccentrically rotating about the geometrical axis in the course of machining in a numerical control grinding machine with a bed, a worktable, for defining said geometrical axis, and a grinding wheel-slide, movable along a direction, transverse with respect to said geometrical axis, wherein said support element is movable with respect to the bed along a direction transverse to the geometrical axis.

7. The apparatus according to claim 6, wherein said support element is coupled to a slide, movable with respect to the bed, by means of a hydraulic actuator, said actuator including a cylinder and a piston, said piston being coupled to the slide, and said cylinder being coupled to the bed.

8. The apparatus according to claim 1, wherein the measuring device includes a transmission rod and a feeler, coupled to the transmission rod, adapted for contacting said substantially cylindrical eccentric portion, said transmission rod being adapted for performing transverse displacements with respect to the geometrical axis of the mechanical piece, depending on the diametral dimensions of the substantially cylindrical eccentric portion.

9. The apparatus according to claim 8, wherein said measuring device includes a measurement transducer for detecting the amount of the transverse displacements of said transmission rod.

10. The apparatus according to claim 9, including a tubular guide casing, coupled to said second rotating, coupling element, said tubular guide casing internally housing the movable transmission rod.

11. The apparatus according to claim 10, including guide means for guiding the displacements of the transmission rod with respect to the tubular casing and antirotation devices for preventing the rotations of the transmission rod with respect to the guide casing.

12. The apparatus according to claim 1, wherein the substantially Vee-shaped reference device is coupled to the second coupling element in a mutually adjustable position substantially in the direction of a bisecting line of said substantially Vee-shaped reference device.

13. The apparatus according to claim 1, wherein said substantially Vee-shaped reference device can be replaced for allowing variations of a measuring range of the measuring device.

14. An apparatus for the diameter checking of a substantially cylindrical eccentric portion of a mechanical piece that defines a geometrical axis, during eccentric rotations of said portion about said geometrical axis in the course of machining in a numerical control grinding machine with a bed, a worktable, for defining said geometrical axis, and a grinding wheel-slide, movable alone a direction transverse with respect to said geometrical axis, including a substantially Vee-shaped reference device adapted for cooperating with said eccentric portion to be checked, a measuring device, movable with the substantially Vee-shaped reference device, and a support device for supporting the substantially Vee-shaped reference device and the measuring device, the support device including a support element, a first rotating, coupling element coupled to the support element so as to rotate about an axis of rotation parallel to said geometrical axis, a second rotating, coupling element that carries the substantially Vee-shaped reference device and the measuring device and is coupled to the first coupling element so as to rotate relative to it about an additional axis of rotation parallel to said geometrical axis and to said axis of rotation, limiting and reference devices, for limiting the rotations of said first rotating, coupling element and said second rotating, coupling element and for defining a rest condition of the apparatus without interfering with displacements of the substantially Vee-shaped reference device following the substantially cylindrical portion during said eccentric rotations, a thrust device for urging said substantially Vee-shaped reference device in abutment with the cylindrical eccentric portion to be checked and keeping the substantially Vee-shaped reference device engaged with the cylindrical eccentric portion during said eccentric rotations, the thrust device being arranged between the support element and one of said first and second coupling elements, the abutment surfaces of said first pair and second pair are detached from each other during the checking of the eccentric portion, and a detecting device adapted to detect an angular position of said substantially cylindrical eccentric portion to be checked about said geometrical axis, the detecting device including a linear gauge providing a signal indicative of the position of the first rotating, coupling element with respect to the support element.

15. The apparatus according to claim 14, wherein said detecting device includes a protruding element integral with the first rotating, coupling element, said linear gauge being fixed with respect to said support element and comprising a feeler adapted to touch the protruding element.

* * * * *